US010486943B2

(12) United States Patent
Püntener et al.

(10) Patent No.: US 10,486,943 B2
(45) Date of Patent: Nov. 26, 2019

(54) METHOD FOR INSTALLING GUIDE RAILS

(71) Applicant: INVENTIO AG, Hergiswil (CH)

(72) Inventors: Urs Püntener, Shanghai (CN); Stefan Buntschu, Incheon (KR)

(73) Assignee: INVENTIO AG, Hergiswil (CH)

( * ) Notice: Subject to any disclaimer, the term of this patent is extended or adjusted under 35 U.S.C. 154(b) by 235 days.

(21) Appl. No.: 15/522,817

(22) PCT Filed: Oct. 30, 2015

(86) PCT No.: PCT/EP2015/075217
§ 371 (c)(1),
(2) Date: Apr. 28, 2017

(87) PCT Pub. No.: WO2016/066786
PCT Pub. Date: May 6, 2016

(65) Prior Publication Data

US 2017/0313553 A1 Nov. 2, 2017

(30) Foreign Application Priority Data

Oct. 30, 2014 (EP) ..... 14191138

(51) Int. Cl.
*B66B 19/00* (2006.01)

(52) U.S. Cl.
CPC ..... *B66B 19/002* (2013.01)

(58) Field of Classification Search
CPC ..... B66B 19/002
See application file for complete search history.

(56) References Cited

U.S. PATENT DOCUMENTS

| | | | | |
|---|---|---|---|---|
| 2,402,888 | A | 6/1946 | Hall | |
| 3,335,635 | A | 8/1967 | Sidler | |
| 2013/0036598 | A1* | 2/2013 | Menchini | B66B 19/002 29/464 |

FOREIGN PATENT DOCUMENTS

| | | | |
|---|---|---|---|
| CN | 1336899 | A | 2/2002 |
| CN | 101495396 | A | 7/2009 |
| JP | H10218530 | A | 8/1998 |
| JP | 2008024387 | A | 2/2008 |
| WO | 0194884 | A1 | 12/2001 |
| WO | 2008053068 | A1 | 5/2008 |
| WO | 20090156557 | A1 | 12/2009 |

* cited by examiner

*Primary Examiner* — John C Hong
(74) *Attorney, Agent, or Firm* — William J. Clemens; Shumaker, Loop & Kendrick, LLP

(57) ABSTRACT

A method for installing a guide rail of an elevator installation arranged in an elevator shaft, wherein the guide rail includes a multiplicity of guide-rail segments that are aligned and arranged in a row one beside the other, includes the following steps: fixing an aligning element in the elevator shaft at a first point in relation to an aligned and fastened first one of the guide-rail segments, wherein the first point is positioned on a route provided by horizontally directed parallel displacement of the route formed by the first guide-rail segment; fixing the aligning element at a second point, in the form of a reference point, in the elevator shaft, an aligning-element portion for aligning a second one of the guide-rail segments therefore being formed between the first and the second points; and aligning the second guide-rail segment relative to the aligning-element portion.

12 Claims, 5 Drawing Sheets

METHOD FOR INSTALLING GUIDE RAILS

FIELD

The invention relates to a method for installing a guide rail in an elevator installation.

BACKGROUND

Elevator installations are usually arranged in an elevator shaft connecting a number of floors. Such elevator installations comprise an elevator car and, as the case may be, a counterweight. The elevator car and the counterweight can be traversed along the elevator shaft in opposite directions. Both the elevator car and the counterweight are guided on their assigned guide rails. Such a guide rail comprises a plurality of guide-rail segments which are arranged together in a row and, during the installation of the guide rail, are aligned and fixed in turn one after the other in the elevator shaft. For this purpose, positioning gauges are usually inserted and fastened in a shaft pit of the elevator shaft and also in a shaft head of the elevator shaft. Such positioning gauges comprise means in order, for example, to fasten alignment cords thereto. After their installation, such alignment cords are tensioned along the elevator shaft and form an aid for the alignment of guide-rail segments or guide rails.

Following such positioning of the alignment cord, a first guide-rail segment is fixed in the shaft pit and aligned with the aid of the alignment cord in the subsequent course of the installation of the guide rail. The alignment can be carried out such that the first guide-rail segment is spaced apart over its entire length at a fixed alignment distance from the alignment cord, which means that the guide-rail segment is arranged parallel to the alignment cord. Further guide-rail segments are then arranged in a row with the respective previously aligned and fixed guide-rail segment, are aligned with the aid of the alignment cord and fixed. The alignment of the guide-rail segments can be carried out in such a way that the guide-rail segment is arranged as parallel as possible to the alignment cord. This method of installing an individual guide-rail segment is repeated until such time as the guide rail has the required length, i.e. a last one of the guide-rail segments is aligned and fixed in the region of the shaft head or the shaft pit. Throughout the installation of the guide rails, the alignment cord runs rectilinearly tensioned between these aforementioned positioning gauges.

All buildings comprising elevator shafts are subject to movements. Such movements are caused by external influences, for example due to solar radiation and/or wind. The elevator shaft arranged in the building becomes correspondingly deformed in the course of the installation of the individual guide-rail segments. The effect of this is that the installed guide rail does not have the desired straight course. In addition, the use of the method just described means that the guide rail, proceeding from the first-installed guide-rail segment, is not necessarily arranged essentially parallel to the alignment cord. The reason is that the elevator shaft, on account of the external influences, possibly already during the alignment of the second guide-rail segment to be installed, has a different shape than was the case when the first guide-rail segment was installed. Accordingly, the spacing present between the lower portion of the second guide-rail segment and the alignment cord no longer corresponds to the alignment spacing in the case of the alignment of the second guide-rail segment. Even if each individual guide-rail segment has been aligned parallel with the alignment cord, readjustments of the individual guide-rail segments are therefore required with a considerable amount of time being spent.

The problem of the invention, therefore, is to propose a method for installing a guide rail that allows less time to be spent on installing the guide rail.

SUMMARY

The problem is solved by a method for installing a guide rail of an elevator installation arranged in an elevator shaft, wherein the guide rail comprises a multiplicity of guide-rail segments which are aligned and arranged together in a row, the method comprising the following steps: fixing an alignment element in the elevator shaft in relation to an aligned and fastened first one of the guide-rail segments at a first point, wherein the first point is positioned on a route, which route is positioned by a horizontally directed parallel displacement of the route formed by the first guide-rail segment, fixing of the alignment element at a second point, in the form of a reference point, in the elevator shaft, so that an alignment-element portion for aligning a second one of the guide-rail segments is formed between the first and the second point, and aligning the second guide-rail segment relative to the alignment-element portion.

The route formed by the first guide-rail segment extends, according to the definition, along the guide portion of the first guide-rail segment. Such a reference point denotes one of the points in the elevator shaft which can already be determined before the installation of the guide-rail segments in the elevator shaft, usually inside the shaft head or the shaft pit. The reference point can thus be determined right at the start of the installation of the entire guide rail. The position of the reference point is thus independent of the subsequent deformations of the elevator shaft caused by external influences. The reference point, which can be maintained during the entire installation of the guide-rail segments of the guide rail, is preset by the target position of the uppermost guide-rail segment of the guide rail to be installed, said target position being provided from the start of the installation. This means that the reference point is preset on the one hand by the point in the shaft head/in the shaft pit at which point the guide track is aligned intentionally at the start of the installation, and on the other hand by the alignment spacing of the guide element from this guide track. The reference point can optionally be determined by means of a positioning gauge or another position-determining device. An alignment of the guide-rail segment located in the immediate vicinity of the reference point on the basis of the alignment spacing from the alignment element thus means that the portion of the guide-rail segment located in the immediate vicinity of the reference point is positioned essentially perfectly in the elevator shaft.

The invention is based on the knowledge that the elevator shaft, due to the changing of external influences, can move or become curved to a differing extent possibly during a single day. The external influences can thus bring about a horizontal displacement of the shaft head by several centimeters. This effect occurs to a correspondingly greater extent in the case of a comparatively high elevator shaft. The effect of overlooking such displacements is that the guide rail over its entire length, as a condition of the installation, is essentially not aligned parallel with the alignment element fixed in the elevator shaft and constituted for example as an alignment cord suitable for aligning guide-rail segments. A consequently required realignment of the individual guide-rail segments already aligned with the aid of the alignment element requires a great deal of time.

In order to minimize this expenditure, it has already been attempted to take account of the external influences already during the alignment of the individual guide-rail segment immediately after it has been arranged in a row with the previously aligned and fixed guide-rail segment.

The fixing of the alignment element at a first point is carried out in such a way that the alignment element, preferably in the immediate vicinity of the first point, has an alignment spacing from the first guide-rail segment. The alignment element is also fixed at the second point constituted as a reference point. Once the second guide-rail segment has been arranged in a row with the first aligned and fixed guide-rail segment, the guide-rail segment can be aligned parallel to the alignment element by means of the alignment spacing. Arrangement in a row thus means that the second guide-rail segment is previously fastened, that the guide portions of the two guide-rail segments form an essentially smooth guide track, wherein this essentially smooth guide track is also maintained after the fixing of the second guide-rail segment.

It is thus possible to ensure that the last guide-rail segment to be aligned in the elevator shaft according to this method can be aligned parallel to the alignment element by means of the alignment spacing, and equally the guide-rail segment located in the immediate vicinity of the reference point is positioned essentially along a subsequent ready-aligned guide track in the elevator shaft. The expenditure for the readjustment of the guide rail can thus be reduced to a considerable extent.

In a development of the method, the alignment element is constituted as a laser beam and the second point is formed by a marking. As an alternative to this, the alignment element can be constituted as an alignment cord and can be fastened at the second point by means of at least one fastening device in the elevator shaft. Possibilities of this kind are provided for constituting the alignment element. In the case of the alignment element constituted as a laser beam, an ideally rectilinear course of the alignment element portion is also guaranteed at all times.

In a development of the method, the alignment cord is tensioned in the elevator shaft and a gripping device is arranged at the first point, which gripping device prevents a movement of the alignment cord directed at an angle to the course of the alignment cord. The effect of this is that the alignment cord installed and tensioned before the start of the installation of the guide rail in the elevator shaft merely has to be gripped and fixed along its previously tensioned length before the alignment of a guide-rail segment. The alignment cord can thus be tensioned beforehand by means of a plumb bob. Alternatively, the alignment cord can be tensioned by means of two fastening devices at two different reference points in the elevator shaft before the installation of the guide-rail segments, wherein one of these fastening devices can be arranged at the second point constituted as a reference point. This means that a first end of the alignment cord, which was fixed before the alignment of the guide-rail segment which is now aligned, does not have to be uninstalled and again reinstalled, nor does the alignment cord have to be tensioned again.

In a development of the method, the second point is arranged in the shaft head of the elevator shaft. As an alternative, the second point can be arranged in a shaft pit of the elevator shaft. According to this variant of embodiment, it is possible to install the guide-rail segments of the guide rail starting from the shaft head in the case of the arrangement of the second point in the shaft pit or from the shaft pit in the case of the arrangement of the second point in the shaft head.

In a development of the method, the second point is determined by means of a reference device preferably constituted as a positioning gauge. It is thus made possible for the second point located in the elevator shaft to be located quickly at this point before fixing of the alignment element. Installation of the guide rail is correspondingly speeded up with the aid of this method step.

In a development of the method, the first point is arranged on a second route, which second route has a length equal to half the length of the first guide-rail segment, wherein this second route is determined by a horizontally directed parallel displacement of the route arranged along the first guide rail segment, proceeding from an abutment point constituted at the transition from the first to the second guide-rail segment.

The effect of this is that an alignment of the first guide-rail segment appearing to be defective on account of external influences at the time of the alignment of the second guide-rail segment does not influence the alignment of the second guide-rail segment. This advantage emerges to a greater extent when the installation of the guide rail after the fixing and alignment of the first guide-rail segment is not continued until the morning of the following day. In such a case, the alignment of the elevator shaft has changed overnight due for example to changed solar radiation.

In a development of the method, the second guide-rail segment is arranged in a row with the first guide-rail segment. It is advantageous that the alignment element is positioned relative to the last aligned and fixed first guide-rail segment and therefore deformations of the elevator shaft, which arose during the installation of the first guide-rail segment, do not additionally contribute to the misalignment of the second guide-rail segment.

In a development of the method, the second guide-rail segment is aligned parallel with the fixed alignment-element portion. It thus becomes a simple matter to align the second guide-rail segment with the aid of the alignment element.

DESCRIPTION OF THE DRAWINGS

The invention is explained in greater detail below with the aid of figures. In the figures.

DETAILED DESCRIPTION

Figure 1A:
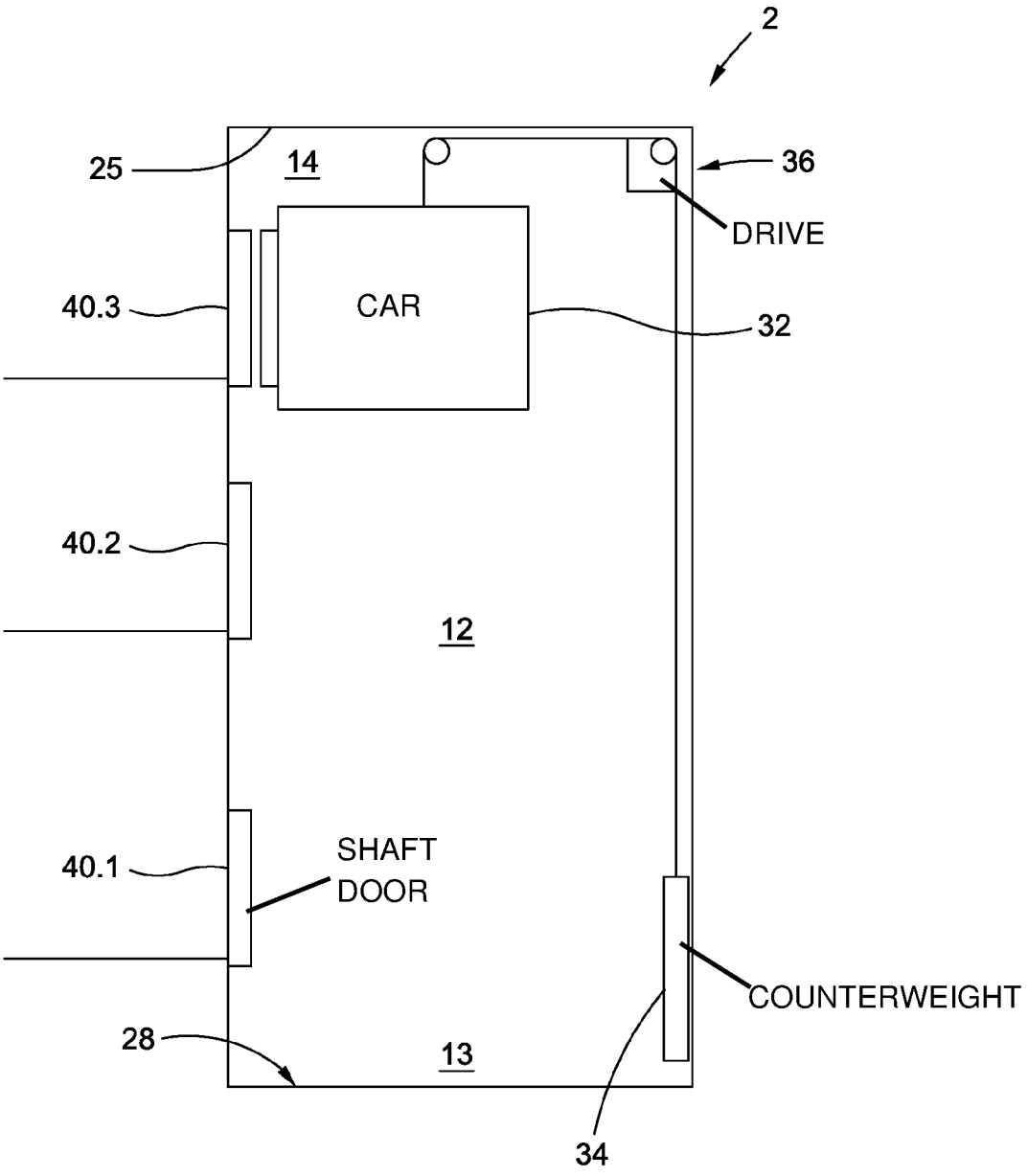
Fig. 1a (Prior Art)
FIG. 1*a*: shows an elevator installation with a plurality of components according to the prior art.

FIG. 1 shows an elevator installation 2 arranged in an elevator shaft 12. Elevator installation 2 comprises an elevator car 32, a multiplicity of shaft doors 40.1, 40.2, 40.3, a drive 36. Moreover, elevator installation 2 comprises a counterweight 34. Elevator shaft 12 comprises a shaft pit 13 arranged at its lower end and at least one shaft wall laterally bounding elevator shaft 12. Elevator shaft 12 is bounded by a shaft floor 28 at its lower end. Elevator shaft 12 can also comprise, at its upper end, a shaft head 14 with a shaft ceiling 25 bounding elevator shaft 12. Elevator car 32 can be traversed along elevator shaft 12 by means of drive 36. Counterweight 34 can, as the case may be, be traversed in the opposite direction to elevator car 32. Elevator car 32 and counterweight 34 are guided on guide rails (not shown). Such a guide rail comprises a plurality of fixed guide-rail segments which are aligned and arranged together in a row.

Figure 1B:
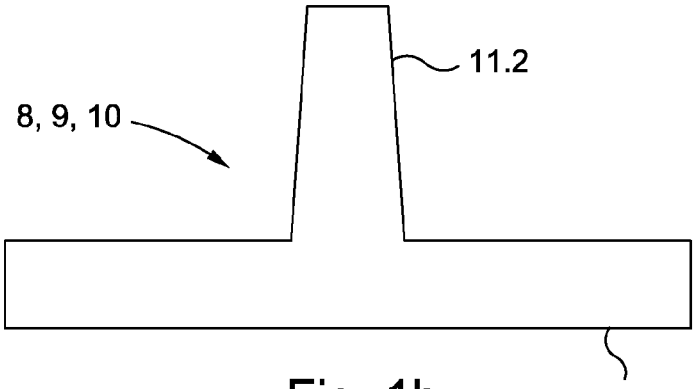
Fig. 1b (Prior Art)
FIG. 1*b*: shows a prior art guide-rail segment in cross-section.

FIG. 1*b* shows the cross-section of such a guide-rail segment 8, 9, 10 or such a guide rail comprising these guide-radial segments 8, 9, 10. Guide-rail segment 8, 9, 10 comprises a fastening portion 11.1 for fixing guide-rail segment 8, 9, 10 in the elevator shaft and a guide portion 11.2 for guiding the elevator car or the counterweight. In the case of a guide rail comprising a plurality of guide-rail segments 8, 9, 10, guide portions 11.2 of individual guide-rail segments 8, 9, 10 form an essentially straight track. That is to say that jerky movements caused by the transitions between individual guide-rail segments 8, 9, 10 during travel of the elevator car along the guide rail are reduced to a large extent.

Figure 2A:
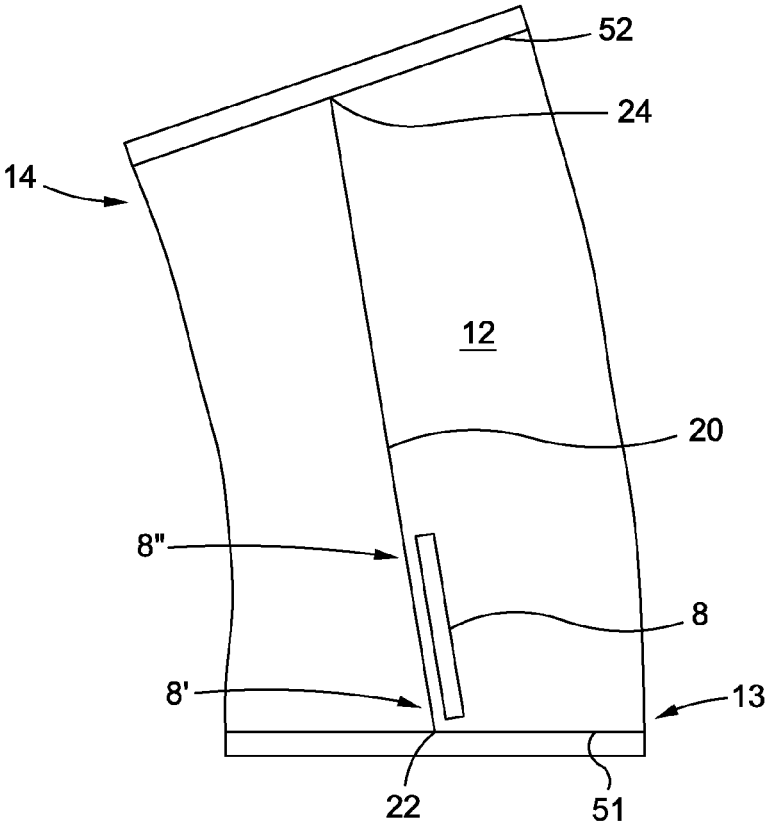
Fig. 2a (Prior Art)
FIG. 2*a*: shows an elevator shaft with an alignment element arranged in this elevator shaft according to the prior art, the elevator shaft having been deformed by external influences.
Figure 2B:
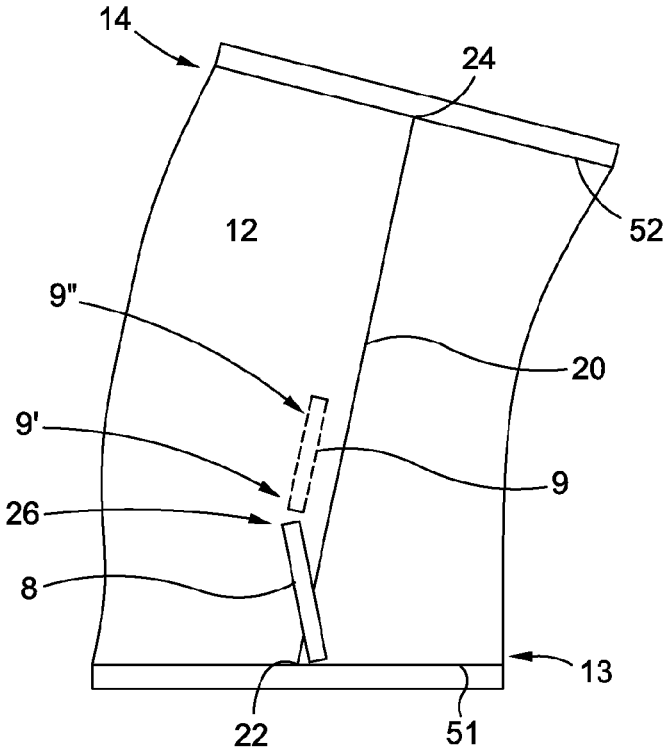
Fig. 2b (Prior Art)
FIG. 2*b*: shows the elevator shaft shown in FIG. 2*a* in the presence of changed external conditions with a first aligned guide-rail segment and a second guide-rail segment to be aligned according to the known prior art.
Figure 2C:
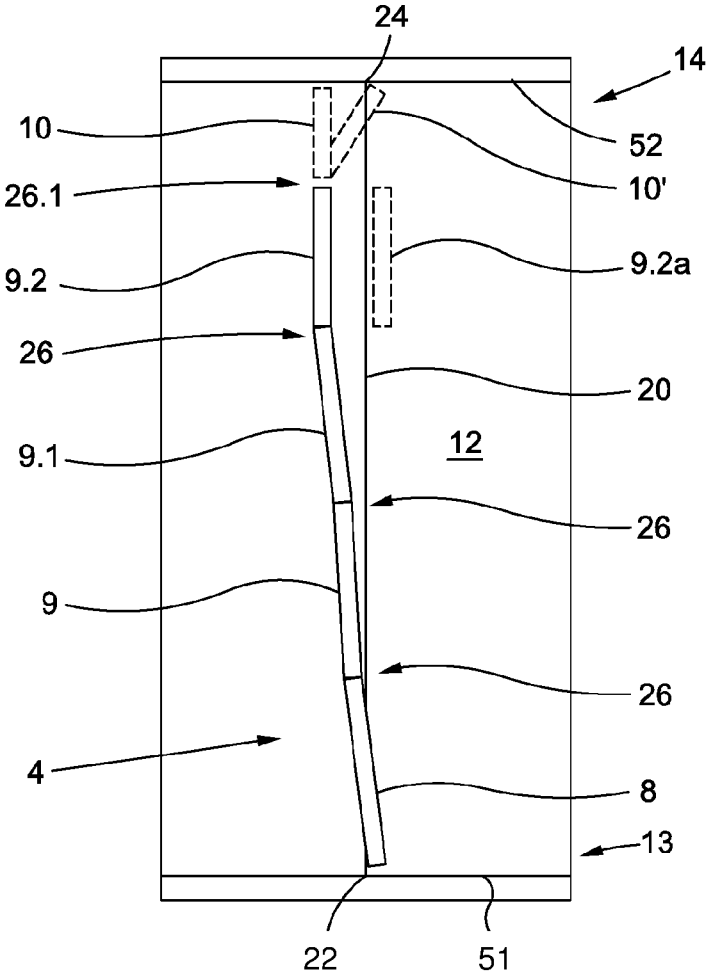
Fig. 2c (Prior Art)
FIG. 2*c*: shows the elevator shaft shown in FIGS. 2*a* and 2*b* during the alignment of a last guide-rail segment belonging to the guide rail.

FIGS. 2*a*, 2*b*, 2*c* show an elevator shaft 12 deformed by external influences and diverging from the vertical at various points in time during the installation of a guide rail. Such external influences can result, amongst other things, from changing climatic conditions such as changed solar radiation or changing wind conditions. The degree of deformation or of alignment diverging from the vertical is dependent on the extent of the external influences at the given observed point in time. The deformations or alignments of elevator shafts 12 diverging from the vertical represented in FIGS. 2*a*, 2*b*, 2*c* are depicted in an exaggerated form in order to make clear the situation resulting therefrom.

An alignment cord 20 is fixed in elevator shaft 12, wherein alignment cord 20 is fixed to a first reference point 22 and to a second reference point 24. The first positioning gauge 51 denoting first reference point 22 is arranged in shaft pit 33. A second positioning gauge 52 denoting second reference point 24 is arranged in shaft head 14. The two reference points can also be determined in elevator shaft 12 independently of such positioning gauges 51, 52 or such positioning gauges 51, 52 can be removed after the determination of reference points 22, 24 for the fastening of alignment cord 20. The alignment cord 20 is tensioned between the two reference points 22, 24 and has an alignment diverging from the vertical due to external influences.

FIG. 2*a* shows elevator shaft 12 immediately after a first of guide-rail segments 8 forming the guide rail is aligned and fixed by means of an alignment spacing. Such a guide-rail segment 8 is usually deemed to be aligned when both an upper portion 8" and a lower portion 8' of guide-rail segment 8 have a constant spacing from alignment cord 20.

Corresponding to alignment cord 20 tensioned according to FIG. 2*a*, first guide-rail segment 8 does not have a vertical alignment, since elevator shaft 12 and therefore alignment cord 20 is not aligned vertically on account of external influences. Since elevator shaft 12 according to FIG. 2*a* also exhibits a curvature, guide-rail segment 8 may exhibit an alignment diverging from the vertical even in the case of a possible alignment of elevator shaft 12 that is both vertical and also curvature-free at a subsequent point in time.

FIGS. 2*b* and 2*c* show elevator shaft 12 shown in FIG. 2*a* at later points in time during the installation of the guide rail, wherein the installation of the guide rail or the guide-rail segments represented in these FIGS. 2*b*, 2*c* is carried out according to a known method.

FIG. 2*b* shows elevator shaft 12 in which first guide-rail element 8 is aligned and fixed according to the description in respect of FIG. 2*a*. A second guide-rail segment 9 is arranged in a row with first guide-rail segment 8 at an abutment point 26, i.e. is previously fastened in such a way that the guide portions of first and second guide-rail segment 8, 9 produce an essentially smooth track. The given spacing of lower portion 9' of second guide-rail segment 9 from alignment cord 20 diverging from the alignment spacing results from the shape of elevator shaft 12 which has changed compared to the shape during the alignment of first guide-rail segment 8. In the subsequent alignment of second guide-rail segment 9, second guide-rail segment 9 is fixed aligned parallel with alignment cord 20. That is to say that upper portion 9" of second guide-rail segment 9 has the same given spacing from alignment cord 20 as lower portion 9' of second guide-rail segment 9. It follows from this that the guide track has a kink at abutment point 26.

FIG. 2*c* shows elevator shaft 12 in which first and second guide-rail segment 8, 9 and further guide-rail segments 9.1, 9.2 have been arranged in a row, aligned and fixed in elevator shaft 12 during the subsequent course of the installation of the guide rail. Further guide-rail segments 9.1, 9.2 are installed like first and second guide-rail segment 8, 9 also according to the description in respect of FIG. 2*b*. According to such an installation of individual guide-rail segments 8, 9, 9.1, 9.2, the guide track of the guide rail has more or less pronounced kinks at individual abutment points 26 arranged between guide-rail segments 8, 9, 9.1, 9.2.

The installation of further guide-rail segments 9.1, 9.2 carried out according to the description in respect of FIG. 2*b* leads to the uppermost already installed guide-rail segment 9.2 possibly having an excessively large spacing from alignment cord 20 and therefore from ideal position 9.2*a* of this guide-rail segment 9.2. Since represented reference point 24 preferably arranged in shaft head 14 denotes the position at which the guide rail comprising guide-rail segments 8, 9, 9.1, 9.2 must be aligned proceeding from reference point 22, last guide-rail segment 10 of this guide rail to be installed would have to be installed and fastened in such a way that a serious directional of change in the guide track of the guide rail would arise at abutment point 26.1. According to the procedure described in FIG. 2*b*, a readjustment of all guide-rail segments 8, 9, 9.1, 9.2 is correspondingly required in increased measure. Neglecting the alignment spacing in the immediate vicinity of upper reference point 24 would lead to last guide-rail segment 10 to be installed being fixed in a position 10' represented in FIG. 2*c*. It can readily be seen that the guide rail constituted according to the positions of guide-rail segments 8, 9, 9.1, 9.2, 10' would be aligned essentially not parallel to the alignment cord over its entire length.

Figure 3:
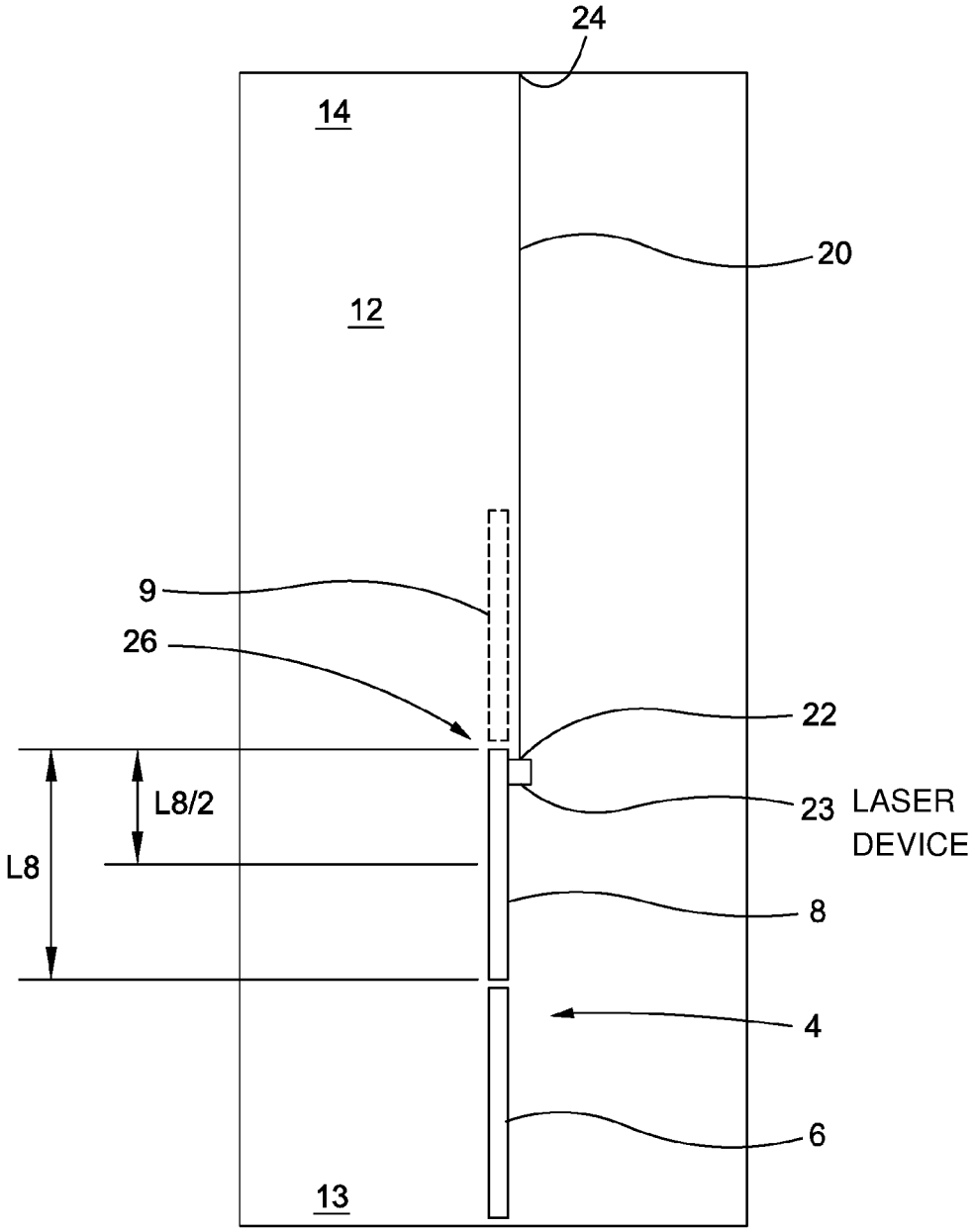
FIG. 3: shows an elevator shaft during the installation of a guide-rail segment of the guide rail according to the method of the invention.

FIG. 3 shows an elevator shaft 12. Elevator shaft 12 comprises a shaft pit 13 and a shaft head 14. At least one guide-rail segment 6, 8 of guide rail 4 is already installed, i.e. aligned and fixed, in elevator shaft 12. Guide-rail segment 6 of the guide rail installed first in elevator shaft 12, i.e. arranged at the bottom in FIG. 3, can have been be aligned and fixed by means of the alignment spacing according to the procedure described in respect of FIG. 2*a*. Guide-rail segment 8 of guide rail 4 installed last, i.e. the uppermost thereof, has a length L8. The free end of the last-installed guide-rail segment 8 forms an abutment point 26 for lining up a second guide-rail segment 9 to be installed. This means that said abutment point 26 is formed at the subsequently constituted transition between last-installed guide-rail segment 8 and second guide-rail segment 9.

As an alternative to the installation of individual guide-rail segments 6, 8, 9 from shaft pit 13 in the direction of shaft head 14, as shown in FIG. 3, guide rail 4 can be installed in such a way that a first guide-rail segment of the guide rail is installed in shaft head 14 and the further guide-rail segments are arranged in a row, aligned and fixed from shaft head 14 in the direction of shaft pit 13. The result of this would therefore be that the second point constituted as a reference point would be arranged in shaft pit 13, preferably at the shaft floor of elevator shaft 12.

First point 22 is preferably positioned on a route which is half the length L8/2 of the last-installed guide-rail segment 8. This route is determined by a horizontally directed parallel displacement of a route extending from abutment point 26 and formed along first guide-rail segment 8.

A reference point 24 of alignment element 20 is arranged in shaft head 14, preferably at the shaft ceiling of elevator shaft 12. Alignment element 20 is preferably installed in such a way that a preferably rectilinear alignment-element portion for the alignment of second guide-rail segment 9 is formed between first point 22 and second point 24 constituted as a reference point.

A laser device 23 can be arranged in elevator shaft 12, preferably at the last-installed guide-rail segment 8, in such a way that a laser beam 20 on the one hand exits at first point 22 from laser device 23 or is directed onto first point 22 and on the other hand, moreover, is directed onto second point 24. Laser beam 20 thus forms the aforementioned alignment element.

As an alternative, alignment element 20 can be formed by an alignment cord, which is fastened to second point 24 constituted as a reference point and tensioned for example by means of a plumb bob or a further fastening device in elevator shaft 12. A gripping device can accordingly be arranged at first point 22 determined on the basis of the last-installed guide-rail segment, said gripping device ensuring that alignment cord 20, during the alignment of second guide-rail segment 9, runs through this point 22, i.e. a movement of alignment cord 20 directed at an angle to the course of the alignment cord is prevented. An alignment-element portion is thus formed between first point 22 and reference point 24, by means of which alignment-element portion an alignment of second guide-rail segment 9 is enabled.

In the subsequent course of the installation of the guide rail, second guide-rail segment 9 is arranged in a row with this last-installed guide-rail segment 8 at an abutment point 26, i.e. roughly aligned and previously fastened. That is to say that the guide portions of last-installed and second guide-rail segment 8, 9, by means of this lining up of the latter, constitute an essentially smooth guide track of guide rail 4 at abutment point 26.

Second guide-rail segment 9 is then aligned with respect to the alignment-element portion formed between first and second point 22, 24. That is to say that second guide-rail segment 9 immediately after such an alignment is arranged essentially parallel with alignment element 20, wherein the alignment of alignment element 20 with respect to the vertical during this alignment is dependent on the external influences acting on elevator shaft 12. Second guide-rail segment 9 is usually fixed after the alignment has taken place, in order to maintain the alignment.

Figure 4:
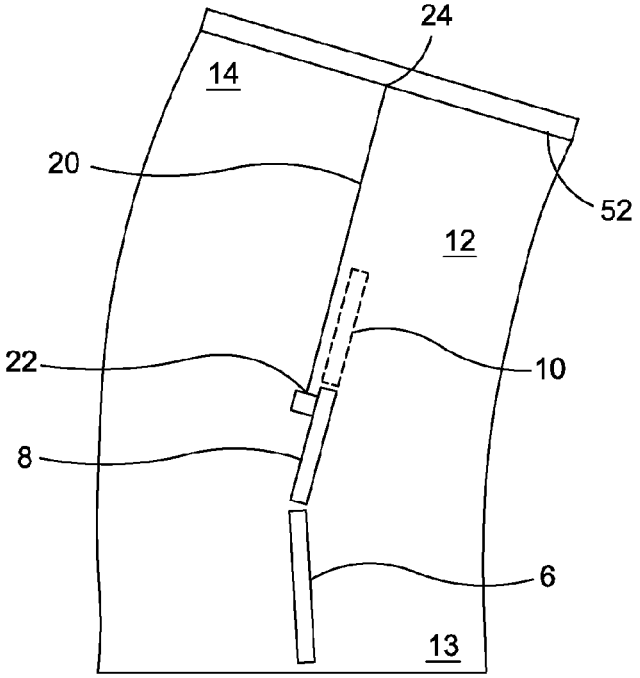
FIG. 4: shows an alignment of a guide-rail segment in the elevator shaft of FIG. 3 deformed due to external conditions.

FIG. 4 shows a further elevator shaft 12 constituted according to FIG. 1, which is deformed on account of changing external influences during the installation of a guide rail. Just as in FIGS. 2*a*, 2*b*, 2*c*, the deformations of elevator shaft 12 are represented in an exaggerated form. Installed guide-rail segments 6, 8 in FIG. 4 have been arranged in a row and fixed according to the description in respect of FIG. 3.

Finally, the effect of such a method of installation is that, in contrast with the procedure represented according to FIG. 2*c*, last guide-rail segment 9 to be aligned is aligned essentially in the direction of reference point 24. The abutment points between individual guide-rail segments 6, 8, 9 may exhibit kinks which necessitate a readjustment possibly of all guide-rail segments 6, 8, 9, but a very extensive readjustment represented according to FIG. 2*c* is not required to the described considerable extent.

Figure 5A:
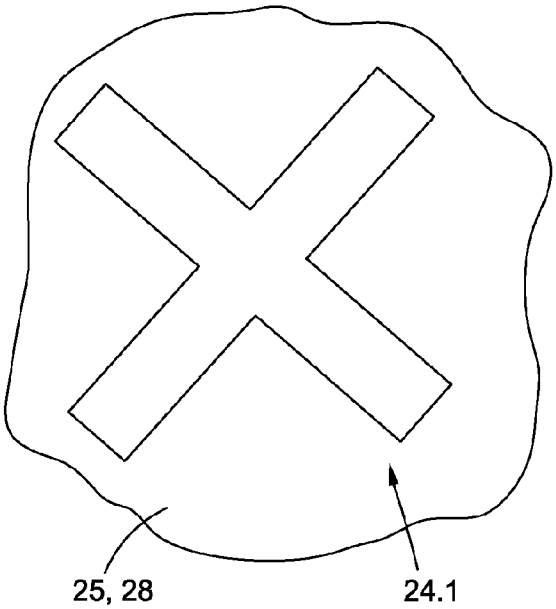
FIG. 5*a*: shows a marking arranged on a shaft floor or a shaft ceiling.

FIG. 5*a* shows a marking 24.1, which marking 24.1 is arranged in a shaft head, preferably on a shaft ceiling 25. Such a marking 24.1 is used for the fixing of an alignment element in elevator shaft 12. An alignment element constituted as a laser beam used for the described method can be aligned on this marking 24.1. Such a laser beam aligned on this marking 24.1 is deemed to be fixed to a point corresponding to marking 24.1. Such a marking 24.1 can alternatively be arranged on shaft floor 28 or on a wall bounding the elevator shaft.

Figure 5B:
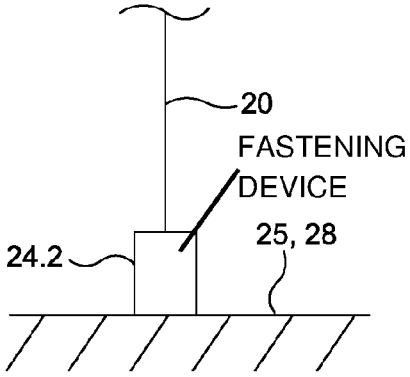
FIG. 5*b*: shows a fastening device on a shaft ceiling or a shaft floor for fastening an alignment cord.

FIG. 5*b* shows a fastening device 24.2, by means of which an alignment element 20 preferably constituted as an alignment cord is fastened in the elevator shaft, preferably to the reference point. Fastening device 24.2 is thus used for the fastening of alignment element 20 to a shaft floor 28 or to a shaft ceiling 25 or to a wall bounding the elevator shaft.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for installing a guide rail of an elevator installation arranged in an elevator shaft, wherein the guide rail includes a plurality of guide-rail segments that are aligned and arranged together in a row, the method comprising the following steps:

fixing an alignment element at a first point in the elevator shaft in relation to an aligned and fastened first one of the guide-rail segments, wherein the first point is positioned on a route being positioned by a horizontally directed parallel displacement of the route formed by the first guide-rail segment;

fixing of the alignment element at a second point as a reference point in the elevator shaft so that an alignment-element portion for aligning a second one of the guide-rail segments is formed between the first point and the second point, wherein the reference point is maintained during the installation of all of the guide-rail segments of the guide rail; and aligning the second guide-rail segment relative to the alignment-element portion.

2. The method according to claim 1 wherein the alignment element is generated as a laser beam from a laser device and the second point is formed by a marking in the elevator shaft.

3. The method according to claim 1 wherein the alignment element is an alignment cord and is fastened to the second point by at least one fastening device in the elevator shaft.

4. The method according to claim 3 wherein the alignment cord is tensioned in the elevator shaft and a gripping device is arranged at the first point, the gripping device preventing a movement of the alignment cord directed at an angle to a course of the alignment cord.

5. The method according to claim 1 wherein the second point is arranged in a shaft head of the elevator shaft or in a shaft pit of the elevator shaft.

6. The method according to claim 1 wherein the second point is determined by using a reference device.

7. The method according to claim 6 wherein the reference device is a positioning gauge.

8. The method according to claim 1 wherein the route is a first route, wherein the first point is arranged on a second route having a length equal to half of a length of the first guide-rail segment, wherein the second route is determined by a horizontally directed parallel displacement of the first route arranged along the first guide-rail segment proceeding from an abutment point at a transition from the first guide-rail segment to the second guide-rail segment.

9. The method according to claim 1 wherein the second guide-rail segment is arranged in a row with the first guide-rail segment.

10. The method according to claim 1 wherein the second guide-rail segment is aligned parallel with the fixed alignment-element portion.

11. The method according to claim 1 wherein the reference point is determined at a start of an installation of the guide rail in the elevator shaft.

12. A method for installing a guide rail of an elevator installation arranged in an elevator shaft, wherein the guide rail includes a plurality of guide-rail segments that are aligned and arranged together in a row, the method comprising the following steps:

fixing an alignment element at a first point in the elevator shaft in relation to a first one of the guide-rail segments aligned and fastened in the elevator shaft, wherein the first point is positioned on a route being positioned by a horizontally directed parallel displacement of the route formed by the first guide-rail segment;

fixing of the alignment element at a second point as a reference point in the elevator shaft so that an alignment-element portion for aligning a second one of the guide-rail segments is formed between the first point and the second point, wherein the reference point is maintained during the installation of all of the guide-rail segments of the guide rail;

aligning the second guide-rail segment relative to the alignment-element portion; and wherein the route is a first route, wherein the first point is arranged on a second route having a length equal to half of a length of the first guide-rail segment, and wherein the second route is determined by a horizontally directed parallel displacement of the first route arranged along the first guide-rail segment proceeding from an abutment point at a transition from the first guide-rail segment to the second guide-rail segment.

* * * * *